US008440912B1

(12) United States Patent
Kraus, Jr. et al.

(10) Patent No.: US 8,440,912 B1
(45) Date of Patent: May 14, 2013

(54) SECURING ELECTRICAL DEVICES

(75) Inventors: David P. Kraus, Jr., Amherst, NH (US); Kristel Hinton, Golden, CO (US); Christopher M. Gallant, Nottingham, NH (US); Mark A. Clarner, Concord, NH (US); Vamshideep Devershetty, New Bedford, MA (US)

(73) Assignee: Velcro Industries B.V., Willemstad, Curacao ( * ) Notice: Subject to any disclaimer, the term of this patent is extended or adjusted under 35 U.S.C. 154(b) by 0 days.

(21) Appl. No.: 13/251,506

(22) Filed: Oct. 3, 2011

Related U.S. Application Data

(62) Division of application No. 12/433,353, filed on Apr. 30, 2009, now Pat. No. 8,061,886.

(60) Provisional application No. 61/049,398, filed on Apr. 30, 2008, provisional application No. 61/052,122, filed on May 9, 2008.

(51) Int. Cl.
*H01B 7/08* (2006.01)

(52) U.S. Cl.
USPC ..... 174/117 FF

(58) Field of Classification Search ..... 174/117 F, 174/117 FF
See application file for complete search history.

(56) References Cited

U.S. PATENT DOCUMENTS

| | | | |
|---|---|---|---|
| 2,760,230 | A | 8/1956 | Van Riper |
| 2,893,056 | A | 7/1959 | Henning |
| 3,082,292 | A | 3/1963 | Gore |
| 3,857,397 | A | 12/1974 | Brosseau |
| 4,164,008 | A | 8/1979 | Miller et al. |
| 4,234,531 | A | 11/1980 | Jocteur |
| 4,281,211 | A | 7/1981 | Tatum et al. |
| 4,285,648 | A | 8/1981 | Jocteur |
| 4,444,709 | A | 4/1984 | Hayashi et al. |
| 4,468,435 | A | 8/1984 | Shimba et al. |
| 4,602,191 | A | 7/1986 | Davila |
| 4,709,307 | A | 11/1987 | Branom |
| 4,794,028 | A | 12/1988 | Fischer |
| 4,863,541 | A | 9/1989 | Katz et al. |

(Continued)

FOREIGN PATENT DOCUMENTS

| | | |
|---|---|---|
| DE | 200 19 333 | 1/2001 |
| EP | 0 813 277 | 12/1997 |

(Continued)

OTHER PUBLICATIONS

Velcro Adhesive Guide (6 pages).

(Continued)

*Primary Examiner* — Chau Nguyen
(74) *Attorney, Agent, or Firm* — Fish & Richardson P.C.

(57) ABSTRACT

An electrical cable includes first and second conductive strips and an electrically insulative base extending between and joining the first and second conductive strips and electrically isolating the first conductive strip from the second conductive strip. The first and second conductive strips each include an electrically conductive thermoplastic resin in contact with a longitudinally continuous electrical conductor, the electrically conductive thermoplastic resin having a lower electrical conductivity than the electrical conductor. The electrically conductive thermoplastic resin forms an exposed surface of the cable and a field of fastener elements extending from the exposed surface. Lighting systems and electrical fastening devices include similar features.

9 Claims, 12 Drawing Sheets

U.S. PATENT DOCUMENTS

| | | | | |
|---|---|---|---|---|
| 4,872,243 | A | 10/1989 | Fischer | |
| 4,979,239 | A | 12/1990 | Klein et al. | |
| 5,260,015 | A | 11/1993 | Kennedy et al. | |
| 5,310,964 | A | 5/1994 | Roberts et al. | |
| 5,455,749 | A | 10/1995 | Ferber | |
| 5,457,610 | A | 10/1995 | Bernardoni et al. | |
| 5,492,580 | A | 2/1996 | Frank | |
| 5,498,461 | A | 3/1996 | Rockney | |
| 5,550,408 | A | 8/1996 | Kunitomo et al. | |
| 5,569,549 | A | 10/1996 | Redford | |
| 5,643,651 | A | 7/1997 | Murasaki | |
| 5,694,296 | A | 12/1997 | Urbish et al. | |
| 5,716,574 | A | 2/1998 | Kawasaki | |
| 5,744,080 | A | 4/1998 | Kennedy et al. | |
| 5,763,112 | A | 6/1998 | Redford | |
| 5,836,673 | A | 11/1998 | Lo | |
| 5,938,997 | A | 8/1999 | Sakakibara et al. | |
| 5,945,193 | A | 8/1999 | Pollard et al. | |
| 5,948,337 | A | 9/1999 | Sakakibara et al. | |
| 6,026,563 | A | 2/2000 | Schilson | |
| 6,036,259 | A | 3/2000 | Hertel et al. | |
| 6,106,303 | A | 8/2000 | Wojewnik | |
| 6,210,771 | B1 | 4/2001 | Post et al. | |
| 6,258,311 | B1 | 7/2001 | Jens et al. | |
| 6,395,121 | B1 | 5/2002 | De Bastiani | |
| 6,402,336 | B1 | 6/2002 | Reese | |
| 6,493,933 | B1 | 12/2002 | Post et al. | |
| 6,540,863 | B2 | 4/2003 | Kenney et al. | |
| 6,604,264 | B1 | 8/2003 | Naohara et al. | |
| 6,621,007 | B2 | 9/2003 | Diegmann et al. | |
| 6,640,434 | B1 | 11/2003 | Wojewnik et al. | |
| 6,668,380 | B2 | 12/2003 | Marmaropoulos et al. | |
| 6,697,262 | B2 | 2/2004 | Adams et al. | |
| 6,729,025 | B2 | 5/2004 | Farrell et al. | |
| 6,880,955 | B2 | 4/2005 | Lin | |
| 6,977,055 | B2 | 12/2005 | Gallant et al. | |
| 7,155,819 | B2 | 1/2007 | McConville et al. | |
| 7,524,195 | B2 * | 4/2009 | Ales et al. | 439/66 |
| 7,556,405 | B2 | 7/2009 | Kingsford et al. | |
| 2002/0039290 | A1 | 4/2002 | Lemmens | |
| 2002/0053119 | A1 | 5/2002 | Provost | |
| 2003/0179548 | A1 | 9/2003 | Becker et al. | |
| 2004/0016565 | A1 | 1/2004 | Gallant et al. | |
| 2004/0037079 | A1 | 2/2004 | Luk | |
| 2004/0074067 | A1 | 4/2004 | Browne et al. | |
| 2004/0131823 | A1 | 7/2004 | Rodgers et al. | |
| 2004/0224138 | A1 | 11/2004 | Farrell et al. | |
| 2004/0262029 | A1 | 12/2004 | McConville et al. | |
| 2005/0098454 | A1 | 5/2005 | Gallant et al. | |
| 2005/0116667 | A1 | 6/2005 | Mueller et al. | |
| 2005/0186387 | A1 | 8/2005 | Gallant et al. | |
| 2006/0049545 | A1 | 3/2006 | Gallant et al. | |
| 2006/0050492 | A1 | 3/2006 | Goodwin et al. | |
| 2006/0078732 | A1 | 4/2006 | Gallant et al. | |
| 2007/0003773 | A1 | 1/2007 | Uhara | |
| 2007/0022602 | A1 | 2/2007 | Kingsford et al. | |
| 2007/0025108 | A1 * | 2/2007 | Kingsford et al. | 362/294 |

FOREIGN PATENT DOCUMENTS

| | | | |
|---|---|---|---|
| EP | 1 473 978 | | 11/2004 |
| EP | 1 749 456 | | 2/2007 |
| GB | 2 256 977 | | 12/1992 |
| GB | 2 275 373 | | 8/1994 |
| JP | 50-015384 | A | 2/1975 |
| JP | 59-196214 | | 11/1984 |
| JP | 6-064324 | U | 9/1994 |
| JP | 8-298021 | A | 11/1996 |
| JP | 8-331736 | A | 12/1996 |
| JP | 2000-000107 | A | 1/2000 |
| JP | 2000-209753 | A | 7/2000 |
| JP | 2000-333709 | | 12/2000 |
| JP | 2001-291433 | | 10/2001 |
| JP | 2003-299506 | | 10/2003 |
| WO | WO 01/97738 | | 12/2001 |
| WO | WO 02/035672 | | 5/2002 |
| WO | WO 2004/030994 | | 4/2004 |

OTHER PUBLICATIONS

Premix Technical Data Sheet (2 pages).
Velcro Specialty Tapes Brochure (4 pages).
"Feature Article—Materials: 'Electrically Active' Compounds Surge in Performance", Jun. 2002 (5 pages).
"Advanced Polymer Courses. General Information," http://www.conductivepolymers.com/general.htm (2 pages).
"Marks' Standard Handbook for Mechanical Engineers", p. 15-5 (2 pages).
"Yarns-Noble Biomaterials", http://noblebiomaterials.com/page.asp?itemid=125 (2 pages).
Bakaert brochure on Bekinox® monofilament (3 pages).
Bakaert Fibre Technolgies, VN Yarn Data Table (1 page).

* cited by examiner

SECURING ELECTRICAL DEVICES

This U.S. patent application is a divisional of, and claims priority under 35 U.S.C. 120 from, U.S. Ser. No. 12/433,353, filed Apr. 30, 2009 now U.S. Pat. No. 8,061,886, which claims priority under 35 U.S.C. 119(e) from U.S. provisional patent application 61/049,398, filed Apr. 30, 2008, and entitled "SECURING ELECTRICAL DEVICES" and from U.S. provisional patent application 61/052,122, filed May 9, 2008, and entitled "SECURING ELECTRICAL DEVICES." The entire contents of these priority patent applications are hereby incorporated by reference.

TECHNICAL FIELD

The following disclosure relates to electrical cables and circuits, and more particularly to electrical cables and flexible circuits incorporating fasteners.

BACKGROUND

Electrical cables are often used to conduct electricity between a power source and an electrical device. These electrical cables are sometimes secured in place to provide a fixed electrical conduction path between the power source and the electrical device. For example, in many interior lighting applications, the electrical cables are kept securely behind a wall.

It is often desirable to move an electrical device relative to a power source. Thus, many electrical devices include an electrical cable in the form of a power cord that can move with the electrical device while remaining connected to a fixed power source. For example, many reading lamps include a power cord that electrically connects the reading lamp to a power outlet, and the shape of the power cord changes when a user repositions the reading lamp relative to the power outlet.

SUMMARY

An electrical cable provides releasably attachable engagement such that electrical devices can be detached and repositioned along the electrical cable.

In one aspect, an electrical cable includes: a first conductive strip and a second conductive strip, each conductive strip including: a longitudinally continuous electrical conductor; an electrically conductive thermoplastic resin in contact with the electrical conductor and having a lower electrical conductivity than the electrical conductor, the electrically conductive thermoplastic resin forming both an exposed surface of the cable and a field of fastener element stems extending from the exposed surface; and an electrically insulative base extending between and joining the first conductive strip and the second conductive strip and electrically isolating the first conductive strip from the second conductive strip.

In some embodiments, each longitudinally extending electrical conductor is at least partially embedded within the electrically conducting thermoplastic resin. In some cases, a portion of each conductive strip is at least partially embedded in the electrically insulative base.

In some embodiments, each longitudinally extending electrical conductor is at least partially embedded within the electrically insulative base.

In some embodiments, the electrically insulative base includes a lane of an electrically insulative resin disposed directly between the first conductive strip and the second conductive strip.

In some embodiments, the cable also includes an electrically insulative layer disposed along a portion of an outer surface of at least some of the fastener elements of each field.

In some embodiments, at least one of the longitudinally continuous electrical conductors comprises a wire extending along the cable.

In some embodiments, at least one of the longitudinally continuous electrical conductors comprises conductive yarn extending along the cable. In some cases, the cable also includes a wire at least partially embedded in the conductive yarn.

In some embodiments, at least some of the fastener element stems in each field have respective, distal heads shaped to overhang the exposed surface of thermoplastic resin to releasably engage loop fibers.

In some embodiments, at least some of the fastener element stems in each field are of self-engaging fasteners.

In some embodiments, the electrically insulative base comprises a nylon knit.

In some embodiments, the electrically insulative base comprises a thermoplastic resin.

In some embodiments, the cable also includes an adhesive layer on a back surface of the electrically insulative base, opposite the fields of fastener element stems.

In another aspect, a lighting system includes: a power strip including a first conductive strip and a second conductive strip. Each conductive strip includes: a longitudinally continuous electrical conductor; an electrically conductive thermoplastic resin in contact with the electrical conductor, the electrically conductive thermoplastic resin with a lower electrical conductivity than the electrical conductor, the electrically conductive thermoplastic resin forming an exposed surface of the cable and an array of hook fastener elements integrally formed with and extending from the exposed surface; and an electrically insulative base extending between and joining the first conductive strip and the second conductive strip and electrically isolating the first conductive strip from the second conductive strip. The system also includes multiple discrete lighting units, each lighting unit comprising: a contact portion, a first securing portion, and a second securing portion, the contact portion electrically isolated from each securing portion, the contact portion engageable with the electrical conductor to allow electrical communication therebetween, the first securing portion releasably engageable with the fastener elements of the first fastener strip to allow electrical communication therebetween, the second securing portion releasably engageable with the fastener elements of the second fastener strip to allow electrical communication therebetween.

In some embodiments, the lighting system also includes a longitudinally continuous electrical conductor carried by the electrically insulative base and having an exposed, conductive surface on the front side of the electrically insulative base, wherein the longitudinally continuous electrical paths formed by the fastener strips are spaced from, and arranged on opposite sides of, the electrical conductor.

In some embodiments, the contact portion includes a resilient member configured to bias the contact portion toward the electrical conductor when the securing portions engage the fastener elements.

In some embodiments, each longitudinally extending electrical conductor is at least partially embedded within the electrically insulative base. In some cases, each longitudinally extending electrical conductor is at least partially embedded within the electrically conductive thermoplastic resin. In some cases, a lane of an electrically insulative resin is attached to the electrically insulative base between the first conductive strip and the second conductive strip.

In some embodiments, the lighting system also includes an adhesive layer on a back surface of the electrically insulative base, opposite the first and second conductive strips.

In another aspect, an electrical fastening device includes: a strip-form base having a front side; a longitudinally continuous electrical conductor carried by the strip-form base and having an exposed, conductive surface on the front side of the base; and first and second spaced-apart fastener strips, each fastener strip carrying a field of fastener elements with electrically conductive exposed surfaces, such that each fastener strip forms a respective, longitudinally continuous electrical path on the front side of the base. The longitudinally continuous electrical paths formed by the fastener strips are spaced from, and arranged on opposite sides of, the electrical conductor.

In some embodiments, the first fastener strip and the second fastener strip each comprise an electrically conductive thermoplastic resin. In some cases, the device also includes a longitudinally continuous electrical conductor at least partially embedded in the electrically conductive thermoplastic resin.

In some embodiments, the longitudinally continuous electrical conductor comprises a wire.

In some embodiments, at least some of the fastener elements in each field of fastener elements comprise distal heads engageable with exposed loop fibers.

In some embodiments, the device also includes a first insulative strip and a second insulative strip, each insulative strip disposed between base and the respective fastener strip. In some cases, a height of each insulative strip is greater than a height of the electrical conductor.

In some embodiments, the device also includes an adhesive layer disposed on a back side of the strip-form base, opposite the front side of the strip-form base.

In some embodiments, the device also includes an electrical device including a contact portion, a first securing portion, and a second securing portion, the contact portion electrically isolated from each securing portion, the contact portion engageable with the electrical conductor to allow electrical communication therebetween, the first securing portion releasably engageable with the fastener elements of the first fastener strip to allow electrical communication therebetween, the second securing portion releasably engageable with the fastener elements of the second fastener strip to allow electrical communication therebetween. In some cases, each securing portion comprises exposed loop fibers. In some cases, the contact portion comprises a resilient member configured to bias the contact portion toward the electrical conductor when the securing portions engage the fastener elements.

In some embodiments, the device also includes: a first insulative strip and a second insulative strip, each fastener strip forming a longitudinally continuous insulative path on the front side of the base and each insulative strip disposed between the electrical conductor and the respective fastener strip. In some cases, a height of each insulative strip is greater than a height of the electrical conductor.

In another aspect, an electrical device includes: a housing having an surface, the housing defining an inner volume; a first securing portion extending from the surface of the housing and configured to conduct electricity to the inner volume of the housing; a second securing portion extending from the surface of the housing and configured to conduct electricity to the inner volume of the housing; and a contact portion extending from the surface of the housing, the contact portion electrically isolated from each securing portion, the contact portion engageable with an electrical cable to allow electrical communication therebetween, the first securing portion releasably engageable with fastener elements extending from the electrical cable to allow electrical communication therebetween, and the second securing portion releasably engageable with fastener elements extending from the electrical cable to allow electrical communication therebetween.

In some embodiments, the device also includes: a light source carried by the housing and in electrical communication with the first securing portion, the second securing portion, and the contact portion. In some cases, the light source is configured to direct illumination in a direction substantially opposite the contact portion. In some cases, the light source includes a light emitting diode.

In some embodiments, the first securing portion and the second securing portion are portions of an annulus disposed around the contact portion, the annulus spaced apart from the contact portion.

Embodiments can include one or more of the following advantages.

In some embodiments, the first conductive strip and the second conductive strip each include a field of conductive fastener elements (e.g., loop-engageable hooks made of conductive resin). These fastener elements can releasably secure an electrical device (e.g., a lamp) in position on the electrical cable and electrically connect the electrical device to a power source. For example, without the use of tools, the electrical device can be detached from the electrical cable and securely reattached at any point along the length of the electrical cable.

In some embodiments, the electrical cable includes a longitudinally continuous electrical conductor (electrically conductive yarns or metal wires) in contact with electrically conductive fastener elements which have a higher electrical resistivity than the electrical conductor. More electrically conductive than the thermoplastic resin and the insulative base, the electrical conductor provides a path of low electrical resistance along the length of the electrical cable. Such a configuration reduces power dissipation along the electrical cable. When an electrical device is attached to the electrical cable by engagement with the electrically conductive fastener elements, the somewhat less conductive fastener elements form only a short portion of the overall electrical connection. Thus, detaching an electrical device from a first position near a power source and reattaching the electrical device at a second position farther away from the power source will not substantially reduce the amount of power delivered to the electrical device. For example, when the electrical device is a lamp, the lamp can shine with substantially equal intensity when positioned to complete an electrical circuit at any point along the electrical cable.

In some embodiments, the electrical conductor is at least partially embedded within an electrically conductive thermoplastic resin forming the electrically conductive fastener elements and/or at least partially embedded in an electrically insulative base. These embodiments can provide good electrical connectivity between the electrical conductor and the electrically conductive fastener elements. These embodiments can also provide good structural stability of the overall structure In some embodiments, the electrical/mechanical connection provided between the electrical cable and associated devices is axisymmetric, such that a user can attach an electrical device to the electrical cable without providing a specific rotational orientation between the electrical cable and the electrical device. Such axisymmetry can simplify attachment of the electrical device to the electrical cable. For example, as compared to an asymmetric electrical cable, a user can more easily attach an electrical device to the axisymmetric electrical cable in dimly lit conditions.

Other aspects, features, and advantages will be apparent from the description and drawings, and from the claims.

DESCRIPTION OF DRAWINGS

Similar reference numbers in different figures indicate similar elements.

DETAILED DESCRIPTION

Figure 1:
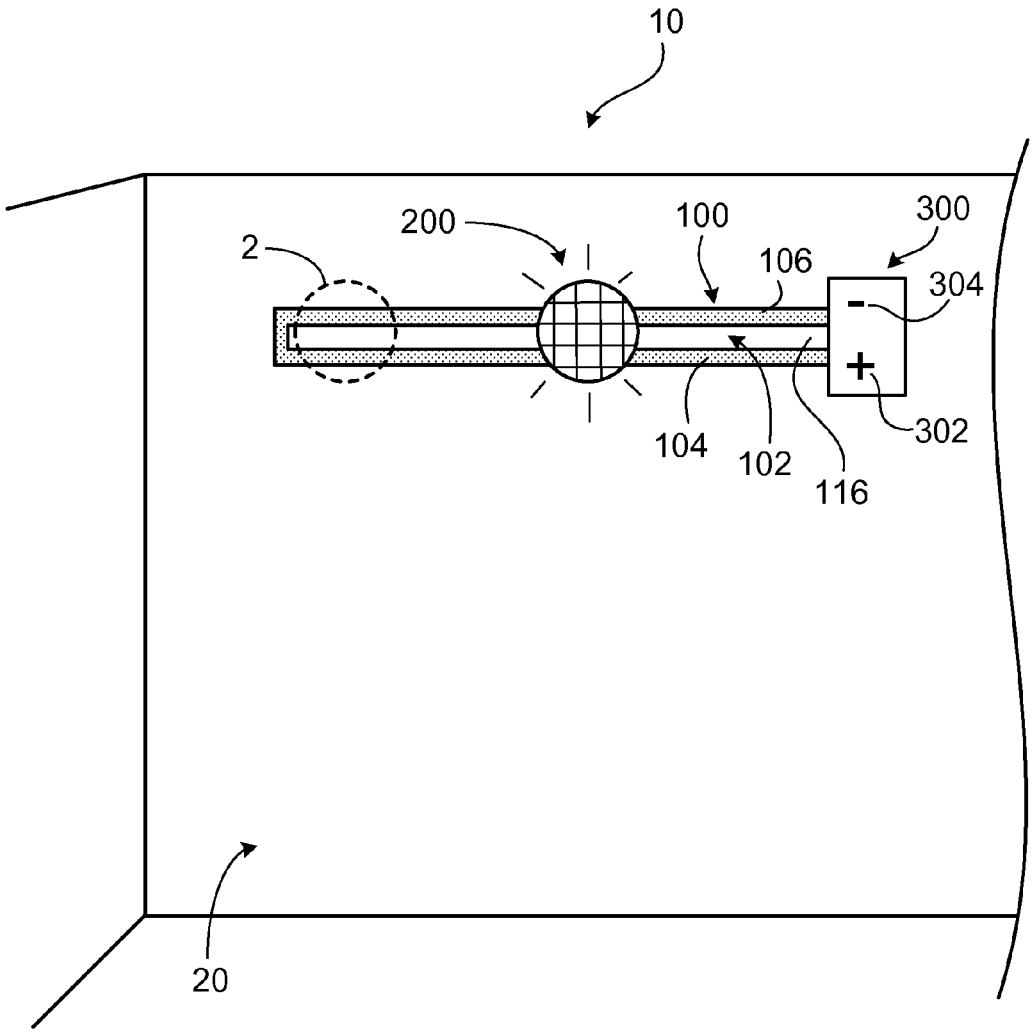
FIG. 1 is a perspective view of a lamp attached to an electrical fastening device mounted to a surface.
Figure 2:
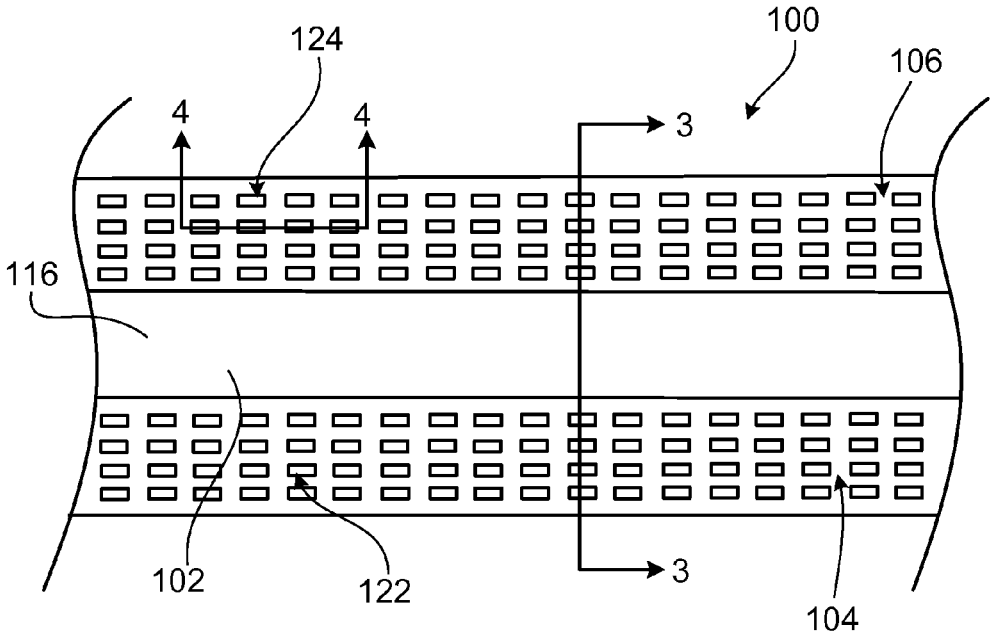
FIG. 2 is an enlarged plan view of region 2 of the electrical fastening device of FIG. 1.
Figure 3:
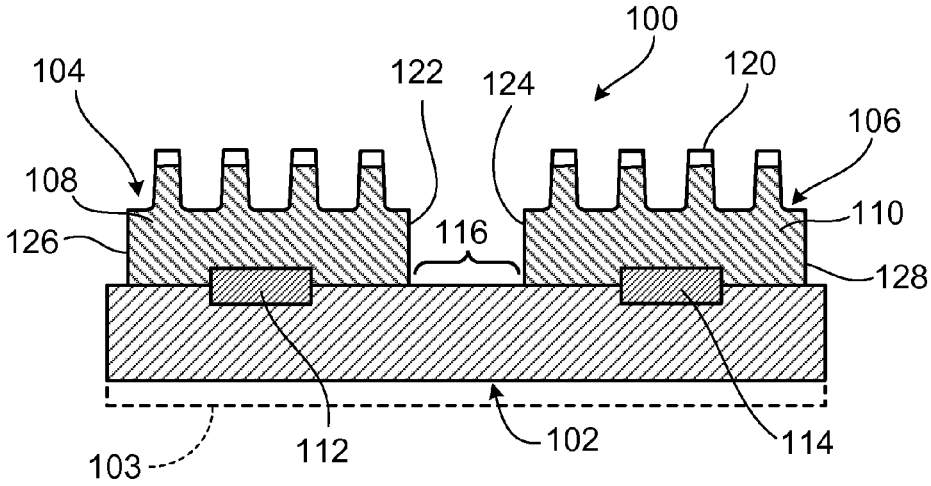
FIG. 3 is a cross-sectional view of the electrical fastening device of FIG. 1, taken along line 3-3 in FIG. 2.

Referring to FIGS. 1-4, a lighting system 10 includes an electrical cable 100 and a lamp 200. Electrical cable 100 is mounted to a surface 20 to provide, for example, a secure base for mounting lamp 200. Lamp 200 is releasably attached to electrical cable 100 such that the lamp can be positioned at multiple different locations along the length of the electrical cable.

In use, a power source 300 is connected to electrical cable 100 and an electric circuit is completed by attaching lamp 200 at any point along the length of the electrical cable. For example, a user can modify a lighting pattern by detaching lamp 200 from a first position along the electrical cable 100 and reattaching lamp 200 to a second position along the electrical cable. Electrical cable 100 includes an insulative base 102 carrying two conductive strips 104, 106 separated by a spacer region 116. Conductive strips 104, 106 include longitudinally continuous electrical conductors 112, 114 and electrically securing strips 108, 110. Securing strips 108, 110 are electrically conductive but have a higher electrical resistivity than electrical conductors 112, 114. Securing strips 108, 110 include fields 122, 124 of fastener elements 120 extending from strip bases 126, 128. Fastener elements 120 can be formed with and of the same material (e.g., an electrically conductive thermoplastic resin) as strip bases 126, 128. As used herein, an electrically conductive thermoplastic resin includes electrically conductive material substantially uniformly dispersed (e.g., in a conductive matrix) throughout a thermoplastic resin and/or an inherently conductive thermoplastic resin.

More electrically conductive than the thermoplastic resin, electrical conductors 112, 114 provide a path of low electrical resistance along the length of electrical cable 100. When lamp 200 is attached to electrical cable 100 by engagement with electrically conductive fastener elements 120, securing strips 108, 110 provide an electrical connection between electrical conductors 112, 114 and lamp 200. Securing strips 108, 110, which are somewhat less conductive than electrical conductors 112, 114, form only a short portion of the overall electrical connection. Thus, detaching lamp 200 from a first position near power source 300 and reattaching at a second position farther away from the power source will not substantially reduce the amount of power delivered to the lamp. Thus, lamp 200 can shine with substantially equal intensity when positioned to complete an electrical circuit at any point along electrical cable 100.

Insulative base 102 extends the length of electrical cable 100 with spacer region 116 extending along the center longitudinal axis of electrical cable 100. First and second conductive strips 104, 106 extend along a top surface of insulative base 102, on respective sides of spacer region 116, such that the insulative base electrically isolates the conductive strips from one another. Spacer region 116 can be about 2 millimeters or greater (e.g. about 6 millimeters, about 12 millimeters), for example, to reduce the potential for electrical shorting between conductors 112, 114. Additionally or alternatively, spacer region 116 can be about 25 millimeters or less (e.g., about 20 millimeters, about 12 millimeters), for example, to reduce the overall width of electrical cable 100 and/or to allow reduction of the overall dimensions of lamp 200 which spans the spacer region.

First and second conductive strips 104, 106 respectively include longitudinally continuous electrical conductors 112, 114 and securing strips 108, 110. Securing strips 108, 110 are carried on (e.g., thermally bonded to or adhesively bonded to) the top surface of insulative base 102. In some embodiments, conductors 112, 114 are substantially equally embedded in insulative base 102 and securing strips 108, 110. Partially embedding conductors 112, 114 in insulative base 102 can increase the amount of force required to separate insulative base 102 from conductive strips 104, 106 to expose conductors 112, 114. Partially embedding conductors 112, 114 in respective securing strips 108, 110 can improve electrical contact between the conductors and the securing strips.

Securing strips 108, 110 include fields 122, 124 of fastener elements 120 extending from respective strip bases 126, 128 and extending substantially the length of electrical cable 100. Securing strips 108, 110 include (e.g., are formed of) electrically conductive thermoplastic resin (e.g., a thermoplastic resin interspersed with electrically conductive fibers, flakes, and/or particles). Examples of electrically conductive thermoplastic resins are available from Premix Thermoplastics, Inc. of Milton, Wis. and include: 46-99x56165-B, 5-999x56155-F; PRE-ELEC PP 1380; PRE-ELEC CP 1319; PRE-ELEC CP 1370; PRE-ELEC 35-000-80A; and PRE-ELEC PC 1431; PRE-ELEC 17-012-HI.

The volumetric resistance of the thermoplastic resin is about 0.04 Ohm-cm or greater and/or about 30,000 Ohm-cm or less. The electrical conductivity of the thermoplastic resin is lower than the electrical conductivity of conductors 112, 114 such that electricity preferentially flows through the conductors, along the length of electrical cable 100. Such a configuration can reduce power dissipation along the length of electrical cable 100. In certain embodiments, the ratio of the electrical conductivity of the thermoplastic resin to the electrical conductivity of conductors 112, 114 is about 500:1 to about $1.5\times10^{10}$:1 (e.g., about 10,000:1). Ratios in this range can reduce power dissipation along the length of electrical cable 100 while allowing electricity to move laterally across the electrical cable when lamp 200 is attached.

Strip bases 126, 128 each have a substantially uniform width along the length of electrical cable 100. Strip bases 126, 128 are wider than respective conductors 112, 114 such that at least a portion of each strip base 126, 128 contacts the top surface of insulative base 102. Larger contact areas between strip bases 126, 128 and insulative base 102 can increase the force required to separate securing strips 108, 110 from the insulative base (e.g., increase the structural integrity of electrical cable 100). Smaller contact areas between strip bases 126, 128 and insulative base 102 can reduce the amount of electrically conductive thermoplastic resin needed in the manufacture of electrical cable 100.

Figure 4:
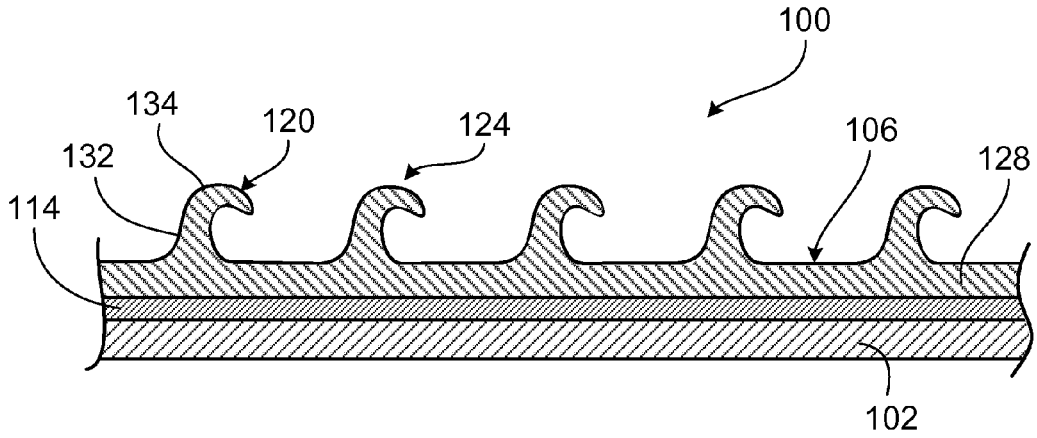
FIG. 4 is a cross-sectional view of the electrical fastening device of FIG. 1, taken along line 4-4 in FIG. 2.

As shown in FIG. 4, fastener elements 120 each include a stem portion 132 and a head portion 134. As described in detail below, fastener elements 120 are releasably engageable to conductive loop material on lamp 200 to form an electrically conductive path between electrical cable 100 and the lamp. In some embodiments, fastener elements 120 are substantially uniform (e.g., made of the same material, dimensioned substantially alike, and oriented alike relative to base 128).

Stem portion 132 extends from base 128. Stem portion 132 can be integrally formed with base 128 and made from the same material as the base (e.g., simultaneously molded from a thermoplastic resin) such that at least the stems and the base form a single, seamless body of resin. In some embodiments, stem portion 132 is wider near base 128 and tapers toward head portion 134.

Head portion 134 extends from stem portion in the shape of a hook extending over at least a portion of base 128. A suitable hook shape is the CFM 29 hook shape of about 0.015 inch height, h, available in various products sold by Velcro USA of Manchester, N.H. Hook height, h, can be about 0.15 millimeters or greater and/or about 6.4 millimeters or less. Other hook shapes and fastener elements can also be used.

For the purposes of illustration and explanation, the portion of electrical cable 100 including second securing strip 110 has been described above. The portion of electrical cable 100 including first securing strip 108 and base 126 includes an analogous configuration.

Conductors 112, 114 have a material resistivity of about less than 80 micro Ohm-cm (e.g., about less than 10 micro Ohm-cm, about less than 2 micro Ohm-cm). As described above, the resistivity of conductors 112, 114 is lower than the resistivity of the conductive thermoplastic resin of strip bases 126, 128 such that the conductors each form a path of low electrical resistance along the length of electrical cable 100. In some cases the conductors are strips of solid metal, such as copper. In general, electricity will preferentially flow along the lower resistivity paths defined by conductors 112, 114, reducing the amount of power dissipated along the length of electrical cable 100. Reduced power dissipation along the length of electrical cable 100 allows lamp 200 to receive substantially equal amounts of power (e.g., to shine with equal intensity) at any point along the length of electrical cable 100. In some embodiments, because electricity will preferentially flow along the lower resistivity paths defined by conductors 112, 114, the higher resistivity of the thermoplastic resin of strip bases 126, 128 can provide some insulation against electric shock such that the user can touch the strip bases 126, 128 without receiving a painful or hazardous shock.

In some embodiments, conductors 112, 114 are conductive yarns having a tenacity of about 100 denier per 34 filament or greater. The conductive yarn is relatively compressible and can reduce irregularities on the surface (e.g., improve flatness) of electrical cable 100. One example of conductive yarn suitable for use in conductors 112, 114 is a metal yarn such as BEKINOX type VN 12/1×275/100 Z/316L, available from Bakaert Corporation of Kortrijk, Belgium. Another example of conductive yarn suitable for use in conductors 112, 114 is a silver coated nylon yarn (e.g., silver coated nylon yarns such as X-STATIC, available from Noble Biomaterials of Scranton, Pa.). Some conductive yarns are sufficiently stretchable that they can adapt to changes in the size of the other components as the other components (e.g., resin strips) change temperature.

Other materials (e.g., metal wires, metallic foil strips, or metalized printed conductors) can be used in place of the conductive yarn. It is desirable to choose materials that have coefficients of thermal expansion similar to the other components and/or are sufficiently stretchable to compensate for the differences in their coefficients of thermal expansion to avoid distortions in the resulting product as it bonds and cools.

Insulative base 102 defines the maximum width of electrical cable 100. Thus, for example, electrical fastening device 10 can be mounted adjacent to (e.g., side-by-side with) another electrical fastening device on surface 20 without short-circuiting. In some embodiments, insulative base 102 has a maximum width of about 25 inches (63.5 centimeters) or less and/or about 0.4 inches (1.0 centimeter) or greater. For example, insulative base 102 has a maximum width of about 1.5 inches (3.8 centimeters).

Insulative base 102 electrically isolates first conductive strip 104 from second conductive strip 106 and can absorb some of the heat generated by the conduction of electricity through the first and second conductive strips. In use, insulative base 102 can be mounted directly to surface 20 in compliance, for example, with local safety regulations for electrical products. In some embodiments, insulative base includes an adhesive layer 103 (e.g., an adhesive layer covered with a protective film). Such an adhesive layer can be used attach cable 100 to surface 20 (e.g., inside of a cabinet).

Insulative base 102 is substantially flexible about a transverse axis defined by electrical cable 100. For example, insulative base 102 can bend to follow a path defined around a convex and/or a concave corner. Additionally or alternatively, insulative base 102 can be flexible about a transverse axis defined by electrical cable 100 to facilitate packaging the electrical cable as a roll (e.g., spool) that can be unwound during installation.

Insulative base 102 can have a minimum thickness of about 0.002 inches (0.05 millimeters) or greater and/or 0.050 inches (1.3 millimeters) or less. Additionally or alternatively, insulative base 102 can include any of various different materials, including one or more of the following: films, paper, knit fabrics, and woven fabrics.

Figure 5:
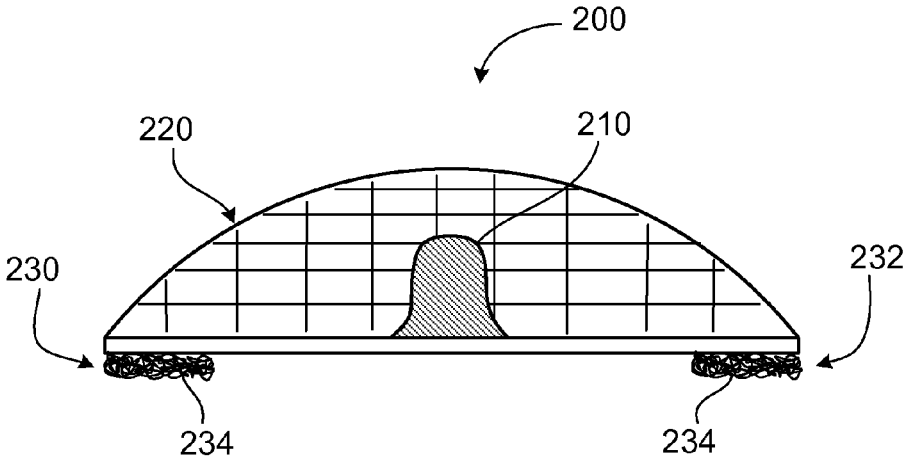
FIG. 5 is a side view of the lamp of FIG. 1.

Referring to FIG. 5, lamp 200 includes an illuminator 210 (e.g., a light emitting diode (LED)), a housing 220, and first and second securing portions 230, 232. Securing portions are electrically conductive and provide an electrical connection between lamp 200 and fastening elements 120 of electrical cable 100. In some embodiments, the illuminator 210 includes solder connectors that are soldered to the first and second securing portions 230, 232.

Illuminator 210 is disposed within housing 220, and at least a portion of the housing is substantially transparent to visible light produced by the illuminator. Securing portions 230, 232 extend from a surface of housing 220 substantially opposite illuminator 210 such that, for example, illuminator can direct light substantially away from surface 20 when lamp 200 is connected to electrical cable 100. In some embodiments, securing portions are adhesively bonded to the surface of housing 220. In certain embodiments, the surface of housing 220 includes a plastic resin and securing portions 230, 232 are partially encapsulated in the plastic resin.

Securing portions 230, 232 are disposed on housing 220 in a pattern that substantially matches the spacing of first and second field 122, 124 of fastener elements 120 on electrical cable 100. In some embodiments, securing portions 230, 232 are separated from one another by a distance substantially equal to the width of spacer region 116 of electrical cable 100. Such spacing of securing portions 230, 232 can, for example, reduce the potential for short circuiting across a single securing portion when lamp 200 is connected to electrical cable 100.

Securing portions 230, 232 include loop material 234 which may be a non-woven, knit, or other fibrous material capable of engaging fastener elements 120 of electrical cable 100. Suitable loop materials and methods and apparatus for their production are disclosed in U.S. Pat. No. 6,329,016, the entire contents of which are incorporated herein by reference. The loop material 234 can be very thin, such as less than about 0.2 inches (5.1 millimeters) and/or greater than about 0.03 inches (0.76 millimeters) thick in an uncompressed state, with web fibers held in a transversely stretched condition and freestanding loop structures extending from its exposed surface. The loop structures extend from associated knots in the stretched web, which may be stabilized by liquid binder wicked into the knots and cured.

Loop material 234 is electrically conductive such that electricity flows from fastener elements 120 through loop material 234 when lamp 200 is fastened to electrical cable 100. Examples of material suitable for loop material include a product marketed under the tradename HI-MEG BRAND loop tape and available from Velcro U.S.A. Corp., Manchester, N.H. and HI-GARDE Brand loop tape Referring again to FIG. 1, power source 300 includes a battery (not shown) electrically connected between a positive lead 302 and a negative lead 304. Positive lead 302 is connected to first conductive strip 104 and negative lead 304 is connected to second conductive strip 106 to provide power to electrical cable 100. When lamp 200 is connected to electrical cable 100 (e.g., forming an electrically conductive path between first conductive strip 104 and second conductive strip 106), power source 300 can provide power sufficient to illuminate lamp 200 at any point along the length of the electrical cable. In some embodiments, power source 300 can supply a variable amount of power to electrical cable 100, for example, to change (e.g., dim, brighten) the illumination from lamp 200.

In some embodiments, power source 300 includes conductive loop material such that the power source can be releasably attached and repositioned along the length of electrical cable 100 (e.g., in a manner analogous to the repositioning of lamp 200 as described above). Additionally or alternatively, positive lead 302 and negative lead 304 can be joined in direct electrical communication to respective conductors 112, 114. As compared to conduction of power through the relatively high resistance of the conductive thermoplastic resin of first and second securing strips 108, 110, such direct electrical communication between positive and negative leads 302, 304 and respective conductors 112, 114 can reduce power dissipation between power source 300 and electrical cable 100.

Figure 6:
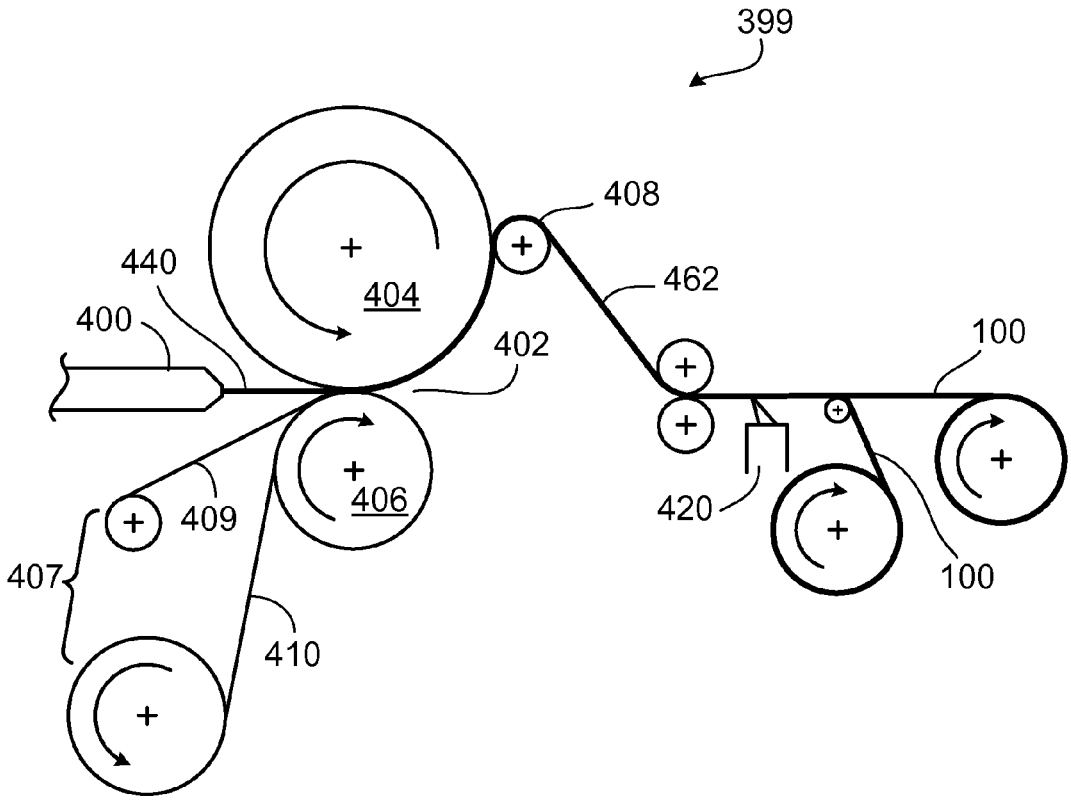
FIG. 6 illustrates a method and apparatus for producing an electrical fastening device.
Figure 6A:
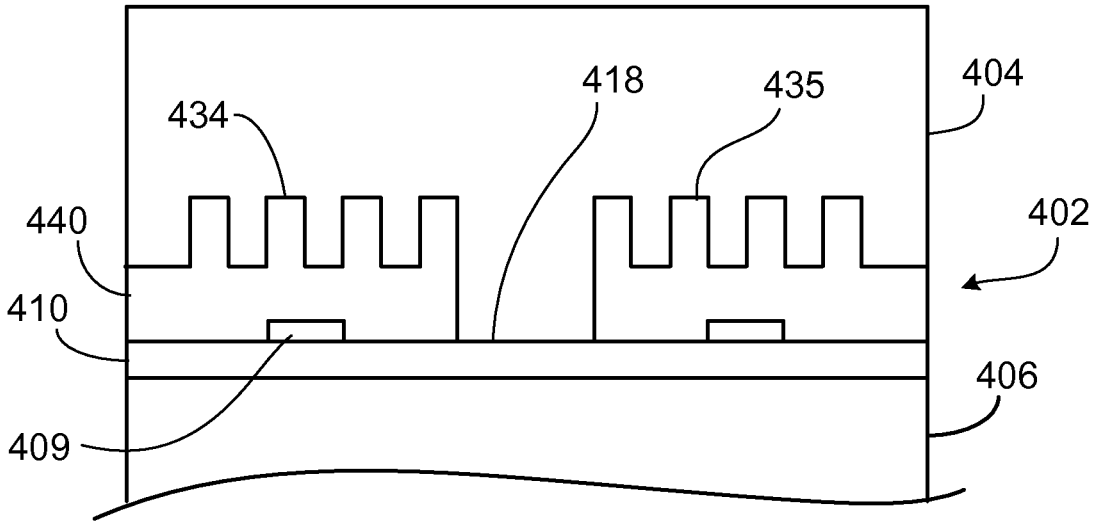
FIG. 6A is a cross-sectional view of the nip of the apparatus of FIG. 6.

Referring to FIGS. 6 and 6A, some methods and apparatus for making the above-described electrical cable 100 are modifications of the continuous extrusion/roll-forming method described by Fischer in U.S. Pat. No. 4,794,028, and the nip lamination process described by Kennedy et al. in U.S. Pat. No. 5,260,015, the entire contents of both of which are incorporated herein by reference. In one example, in extrusion/roll molding apparatus 399, an extrusion head 400 supplies lanes of an electrically conductive resin 440 in moldable (e.g., molten or semi-molten) to a nip 402 between a rotating mold roll 404 and a counter-rotating pressure roll 406. Feeder rolls 407 supply conductive yarn 409 and a sheet of knit nylon material 410 to nip 402 such that the nylon material is adjacent mold roll 406 and the conductive yarn is disposed between the nylon material and resin 440 as they enter the nip. Mold roll 404 includes a flat portion 418 and defines shaped mold cavities 434, 435 extending inward from its periphery on either side of the flat portion (see FIG. 6A). Pressure in nip 402 forces a portion of the electrically conductive thermoplastic resin into arrays of mold cavities 434, 435 and forms resin 440 into fastener elements 120 and strip bases 126, 128 carried on nylon material 410.

The temperature and pressure present in nip 402 laminate resin 440 to nylon material 410. Due to the nature of the knit nylon material 410 used as base 102, resin 440 to some extent infiltrates the nylon sheet such that strands of the nylon fabric are embedded in the resin as it cools and solidifies. In embodiments in which, for example, a polypropylene film is used as base 102, resin 440 and the film can be selected to have similar properties such that they can combine to some extent in the nip.

The composite formed of the resin and the knit nylon is cooled on the mold roll until the fastener elements 120 have solidified enough to be stripped from mold cavities 434, 435 by a stripper roll 408. The product 462 that is stripped from the mold roll 404 includes fastener elements 120 and electrical conductors 112, 114 as illustrated, for example, in FIGS. 1-4 as described above.

In one example, conditions for processing conductive polymer include a melt temperature of 418° F., a die temperature of 420° F., and an extruder pressure of 1500 psi.

Conductive yarn 409 is sufficiently compressible that pressure in nip 402 spreads the yarn laterally across an upper face of nylon material 410. However, when using other less compressible conductors (e.g., metal wires and strips) with the method and apparatus described above, pressure in nip 402 can force electrical conductors 112, 114 to become partially embedded in the electrically conductive thermoplastic resin and partially embedded in the insulative material.

For higher production rates, two or more electrical cables may be simultaneously produced on a single mold roll, and later split and spooled. A sheet of side-by-side electrical cables is split by a blade 420 (FIG. 6) into two (or more) separate runs of electrical cable 100 which are separately spooled.

In this embodiment, fastener elements 120 are hooks which are molded with loop-engageable heads. However, in other embodiments, mold cavities 434, 435 of mold roll 404 are configured to form fastener element stems which are subsequently manipulated to form heads which are loop- or self-engageable.

Figure 8:
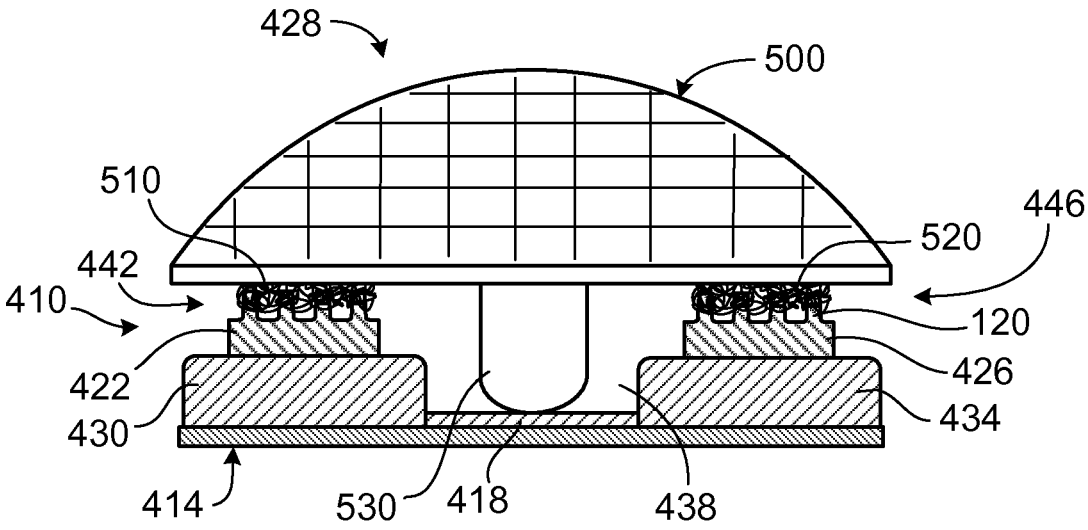
FIG. 8 is a cross-sectional view of the lamp and electrical fastening device of FIG. 7.

The electrical/mechanical connection provided between the electrical cable and associated devices is preferably axisymmetric, such that a user can attach an electrical device to the electrical cable without providing a specific rotational orientation between the electrical cable and the electrical device. Such axisymmetry, as shown in the embodiment of FIG. 8, for example, can simplify attachment of the electrical device to the electrical cable. For example, as compared to an asymmetric electrical cable, a user can more easily attach an electrical device to the axisymmetric electrical cable in dimly lit conditions.

Figure 7:
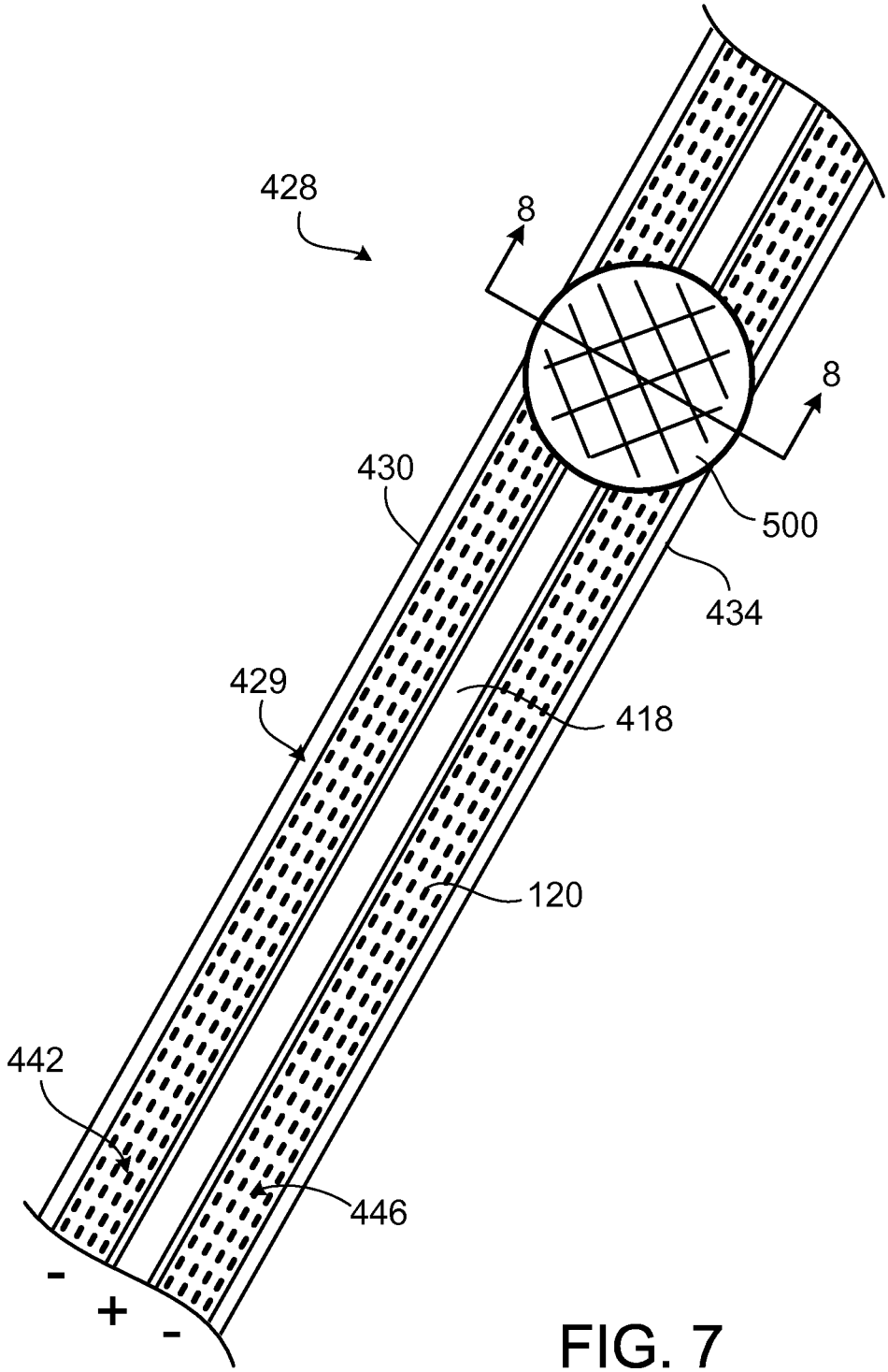
FIG. 7 is a partial perspective view of a lamp attached to an electrical fastening device.

Referring to FIGS. 7 and 8, an exemplary axisymetric lighting system 428 includes an electrical cable 429 and a lamp 500. Lamp 500 is releasably attached to electrical cable 429 such that the lamp can be positioned at multiple different locations along the length of the electrical cable. As described in further detail below, electrical cable 429 is configured to provide an axisymmetric electrical conduction path along its length such that, in use, lamp 500 can be attached to the electrical conduction path in any of various different orientations. As compared to an asymmetric electrical cable, such an axisymmetric electrical cable can allow a user to more easily attach lamp 500 to electrical cable 429 (e.g., in dimly lit conditions).

Electrical cable 429 includes an electrically insulative strip form base 414, first and second insulative strips 430, 434, a longitudinally continuous electrical conductor 418, and first and second electrically conductive fastener strips 422, 426. Electrical conductor 418 is carried on a front side of strip form base 414 and has an exposed, conductive surface on the front side of the base. First and second insulative strips 430, 434 are carried on a front side of strip form base 414, adjacent (e.g., substantially abutting) respective sides of electrical conductor 418. Fastener strips 422, 426 are carried on respective insulative strips 430, 434, such that the fastener strips are spaced from (e.g., electrically isolated from) and arranged on opposite sides of electrical conductor 418.

In use, fastener strips 422, 426 are connected to the same pole of a power source (not shown) while electrical conductor 418 is connected to the opposite pole of the power source. Thus, for example, fastener strips 422, 426 can carry a negative electrical charge while electrical conductor 418 carries a positive electrical charge. An electric circuit can be completed by attaching lamp 500 (as described in further detail below) to establish electrical communication between electrical conductor 418 and at least one of the electrically conductive fastener strips 422, 426.

Strip form base 414 can include (e.g., be formed of) any of various different electrically insulative materials. Examples of materials suitable for use in strip form base 414 include knit materials, polypropylene films, paper, knit fabrics, and woven fabrics. In some embodiments, electrical cable 429 includes an adhesive layer disposed on the back side of strip form base 414, opposite the front side of the strip form base.

Electrical conductor 418 is substantially flat (e.g., a flat wire) to facilitate, for example, mounting electrical conductor 418 on the front face of strip form base 414. Wider widths of electrical conductor 418 result in a larger exposed surface area of the electrical conductor and can, for example, allow a user to more easily align lamp 500 with the electrical conductor. Thinner widths of electrical conductor 418 result in a smaller exposed surface area of the electrical conductor. Such a smaller exposed surface area can, for example, reduce the potential for foreign objects to contact the electrical conductor and short-circuit electrical cable 429. The width of electrical conductor 418 is about 0.5 millimeters or greater and/or about 15 millimeters or less. Electrical conductor 418 can be made of any of various different conductive materials, including the materials described above with respect to electrical conductors 112, 114.

Insulative strips 430, 434 each have a height greater than the height of electrical conductor 418. Accordingly, the respective top surfaces of insulative strips 430, 434 each extend above the top surface of electrical conductor 418 such that the insulative strips and the electrical conductor define a recessed region 438 extending substantially along the length of electrical cable 429. As described in further detail below, recessed region 438 can facilitate alignment of electrical cable 429 with one or more features of lamp 500. Recessed region 438 can have a height of about 0.5 millimeters or greater and/or about 15 millimeters or less. Insulative strips 430, 434 can include (e.g., be formed of) any of various different materials suitable for electrically isolating electrical conductor 418 from electrically conductive fastener strips 422, 426, including the materials described above with respect to insulative base 102.

Fastener strips 422, 426 carry respective fields 442, 446 of fastener elements 120 with electrically conductive exposed surfaces. As describe above, fastener elements 120 are releasably engageable to exposed loop fibers. Fastener strips 422, 426 each have a width that is narrower than a width of respective insulative strips 430, 434. Fastener strips 422, 426 can be positioned away from side edges of respective insulative strips 430, 434 to improve, for example, electrical isolation of the fastener strips. Fastener strips 422, 426 can include (e.g., be formed of) any of various thermoplastic resins, including the electrically conductive thermoplastic resins described above with respect to securing strips 108, 110. In some embodiments, fastener strips 422, 426 each includes a longitudinally continuous electrical conductor at least partially embedded in the respective fastener strips to reduce power dissipation along the length of electrical cable 429 (e.g., in a manner analogous that described above with respect to electrical cable 100).

Figure 9:
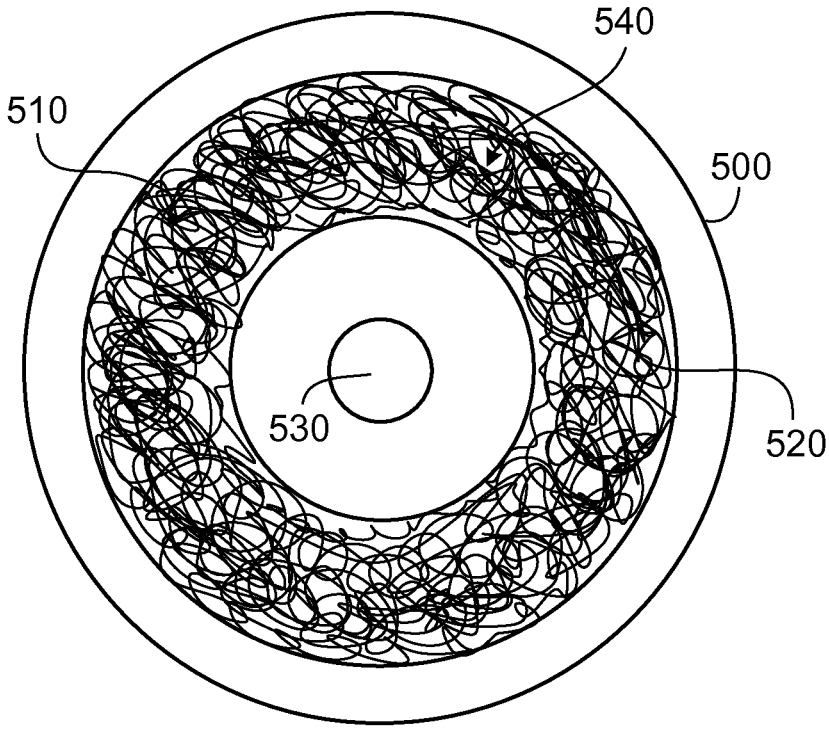
FIG. 9 is a bottom view of the lamp of FIG. 7.

Referring to FIGS. 8 and 9, lamp 500 includes a contact portion 530 and first and second securing portions 510, 520. First and second securing portions 510, 520 are substantially diametrically opposed portions of an annular ring 540 of electrically conductive loop material extending from a bottom surface of lamp 500. Contact portion 530 extends from a bottom surface of lamp 500, substantially along a plane substantially normal to the bottom surface and bisecting annular ring 540 such that the contact portion and the annular ring can engage electrical cable 429 in any of various different orientations. In other words, as long as lamp 500 is placed such that contact portion 530 is aligned with electrical conductor 418, portions of annular ring 540 will be aligned with fastener strips 422, 426 regardless of the rotation of the lamp about the contact portion. In use, lamp 500 is placed in electrical communication with electrical cable 429 by placing contact portion 530 in contact with electrical conductor 418 and engaging first and/or second securing portions 510, 520 with fastener elements 120 on respective first and/or second fastener strips 422, 426.

Contact portion 530 extends from the bottom surface of lamp 500 about 0.25 millimeters or greater and/or about 5 millimeters or less (e.g., about 2 millimeters). Contact portion 530 has a width narrower than a width of recessed region 438 such that the contact portion can be inserted into the recessed region. In some embodiments, contact portion 530 is sized to reduce breakage and/or bending that can result from positioning lamp 500 on electrical cable 429. In certain embodiments, contact portion 530 includes a resilient member (e.g., a spring; not shown) that can allow the contact portion to move relative to lamp 500 while biasing the contact portion toward electrical conductor 418 when securing portions 510, 520 engage fastener elements 120. Such a biased positioning of contact portion 530 can, for example, improve electrical communication between the contact portion and electrical conductor 418. Additionally or alternatively, such a resilient member can reduce breakage of contact portion 530, for example, by allowing the contact portion to move relative lamp 500 when the lamp is being attached to electrical cable 429.

While the above-described contact portion extends from a bottom surface of a lamp, along a plane substantially normal to the bottom surface and bisecting an annular ring of loop material, other embodiments are possible.

Figure 10:
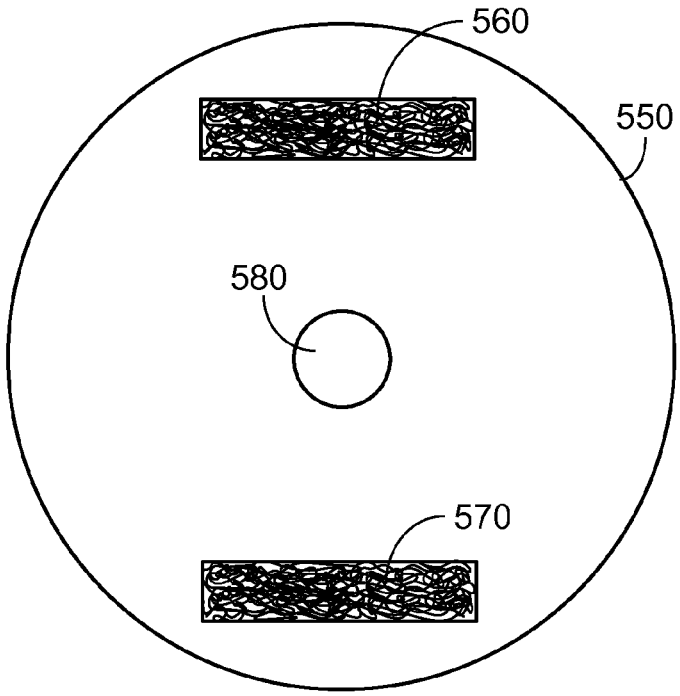
FIG. 10 is a bottom view of a lamp including separate portions of conductive loop material.

Referring to FIG. 10, for example, a lamp 550 includes a contact portion 580 and first and second securing portions 560, 570. Contact portion 580 extends from a bottom surface of lamp 550, along a substantially center axis of the lamp. First and second securing portions 560, 570 are separate sections (e.g., rectangular sections) of loop material. Compared to the above-described annular ring of loop material, securing portions 560, 570 can be more easily applied to the bottom surface of lamp 550. Securing portions 560, 570 extend from the bottom surface of lamp 550, on opposite sides of a plane substantially normal to the bottom surface and bisecting contact portion 580. In this configuration, lamp 550 can be mounted to electrical cable 429 in any of two orientations.

While certain embodiments have been described, other embodiments are possible.

Figure 11:
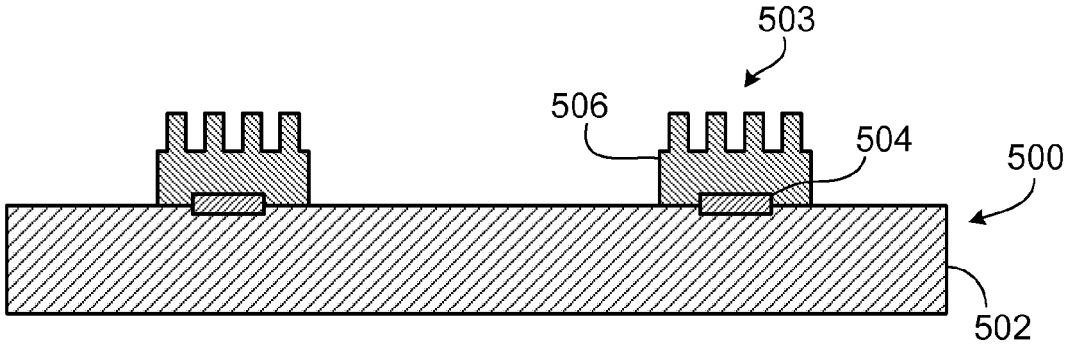
FIG. 11 is a cross-sectional view of an electrical cable.

Referring to FIG. 11, for example, an electrical cable 500 can be formed in which a longitudinally-extending electrically insulative base 502 is molded from an electrically insulative resin rather than being a pre-formed sheet-form member. Electrically insulative base 502 carries conductive strips 503 which include a highly conductive member 504 in contact (e.g., embedded within) with a conductive fastener strip 506.

Figure 12:
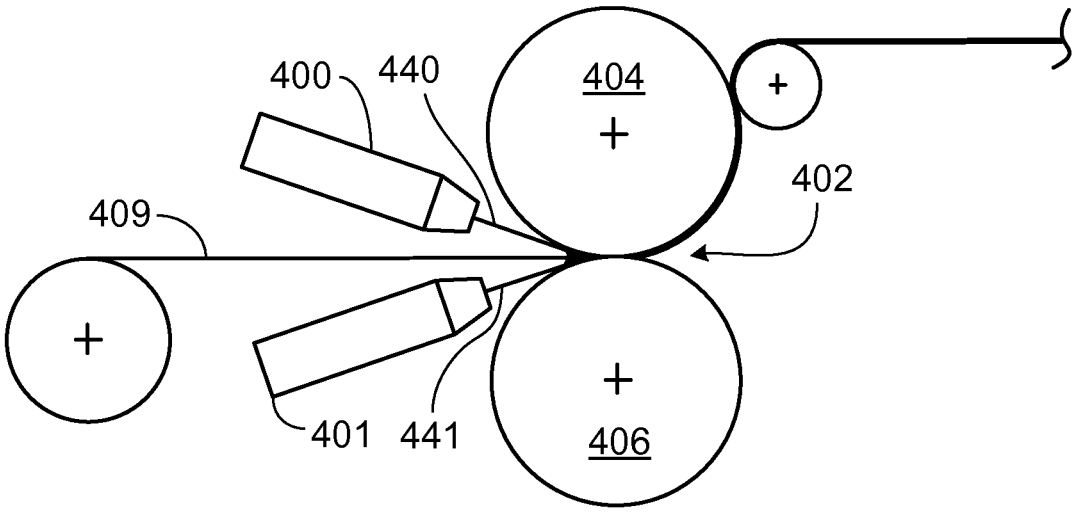
FIG. 12 illustrates another method and apparatus for producing an electrical fastening product.

Referring to FIG. 12, electrical cable 500 can be formed using a mold roll 404 and pressure roll 406 as described above. A first extrusion head 400 supplies lanes of an electrically conductive resin 440 to nip 402, defined between mold roll 404 and pressure roll 406. A second extrusion head 401 supplies a laterally extending sheet of electrically insulative resin 441 to nip. Electrical conductors 409 are supplied to nip 402 such that each electrical conductor is disposed between a lane of the electrically conducive resin 440 and the sheet of electrically insulative resin 441. The two resins 440, 441 are chosen from materials that are sufficiently compatible that the two resins bond together in nip 402.

In another example, the above-described electrical cable embodiments include conductive strips carried on a top surface of an insulative base separated by an air gap. In some embodiments an electrically insulative material is disposed between the conductive strips.

Figure 13:
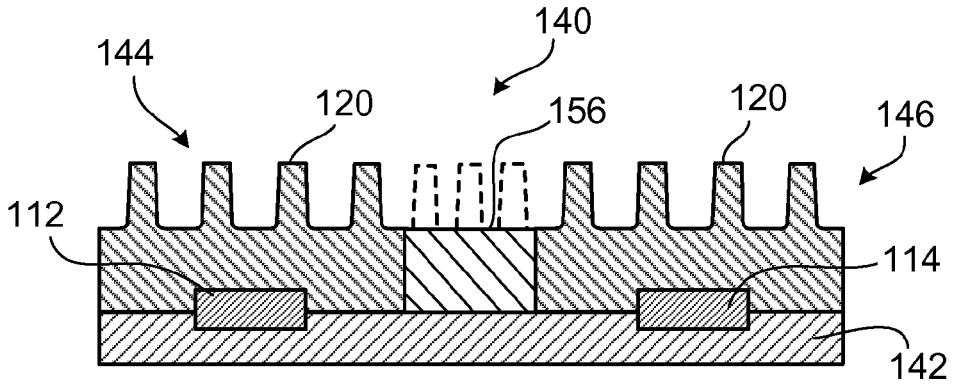
FIG. 13 is a cross-sectional view of an electrical cable.

Referring to FIG. 13, for example, an electrical cable 140 includes an insulative base 142 which carries conductive strips 144, 146 and a lane 156 of electrically insulative material. Lane 156 is disposed (e.g., extends from, is integrally formed with, or is attached to) insulative base 142, along a center longitudinal axis of the insulative base. First and second conductive strips 144, 146 are carried on insulative base 142, on respective sides of a lane 156, such that the lane and the insulative base electrically isolate the conductive strips from one another. Lane 156 can extend to any of various different heights relative to conductive strips 144, 146. For example, a top surface of lane 156 can be substantially parallel to respective top surfaces of conductive strips 144, 146 such that fastener elements 120 project above the top surface of the lane. Such substantially parallel top surfaces can facilitate, for example, forming electrical cable 140 in a continuous extrusion/roll-forming process such as those described above. For example, extrusion head 400 of apparatus 399 (see FIG. 6) can be modified to co-extrude two lanes of electrically conductive resin with a lane of electrically insulative resin disposed between them. In some embodiments, fastener elements 120 can also be formed in the top surface lane 156 of insulative material.

Figure 14:
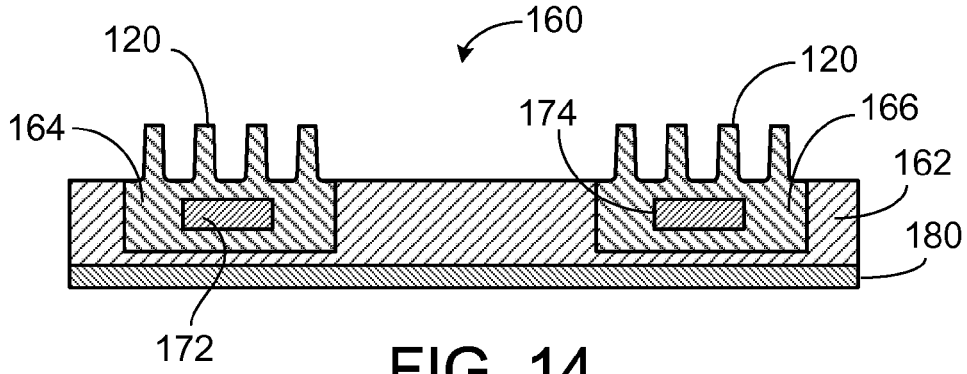
FIG. 14 is a cross sectional view of an electrical cable.

Referring to FIG. 14, in another example, an electrical cable 160 includes first and second conductive strips 164, 166 partially embedded in an insulative base 162. Respective top surfaces of first and second conductor strips 164, 166 are substantially parallel to a top surface of insulative base 162. Fastener elements 120 extend from respective top surfaces of first and second conductor strips 164, 166 and project substantially above the top surface of insulative base 162. As compared to conductor strips carried on a top surface of an insulative base, partially embeddeded conductor strips 164, 166 can reduce the overall height of electrical cable 160. Additionally or alternatively, partially embeddeding conductive strips 164, 166 in insulative base 162 can improve the mechanical integrity of electrical cable 160. For example, as compared to conductor strips carried on a top surface of an insulative base, an increased amount of force can be required to separate conductor strips 164, 166 from insulative base 162.

As another example, while above-described electrical conductors are partially embedded in an insulative base and partially embedded in conductive strips, other embodiments are possible. For example, referring again to FIG. 14, electrical cable 160 includes first and second electrical conductors 172, 174 embedded in first and second conductive strips 164, 166, without direct contact with insulative base 162.

As still another example, the electrical cables described above can include an adhesive layer disposed along at least one surface of the insulative base.

Referring still to FIG. 14, an electrical cable 160 includes an adhesive layer 180 on a back surface of insulative base 162, opposite the first and second conductive strips 164, 166. In some embodiments, adhesive layer 180 is a continuous layer extending substantially the length of insulative base 162. In some embodiments, adhesive layer 180 can be a discontinuous layer (e.g., an interrupted pattern) covering portions of the back surface of insulative base 162. Adhesive layer can include any of various different adhesive materials. Adhesive materials can include hot melt pressure sensitive adhesives, acrylic pressure adhesives, hot melt fire retardant pressure sensitive adhesives, and solvent activated adhesives. For example, adhesive materials can include any of various different adhesives available from Velcro U.S.A. Corp., Manchester, N.H., including VELCRO brand Adhesive 19, VELCRO brand Adhesive 15, VELCRO brand Adhesive 14, VELCRO brand Adhesive 13, VELCRO brand Adhesive 75, and VELCRO brand Adhesive 72, 8222 Adhesive, 8223 Adhesive. In some embodiments, adhesive layer 180 is provided with a protective cover that is removed immediately prior to use.

As yet another example, while the above-described electrical cables include fastener strips carried on insulative strips such that the fastener strips are spaced from and arranged opposite an electrical conductor, the fastener strips and the electrical conductor can be electrically isolated in other configurations.

Figure 15:
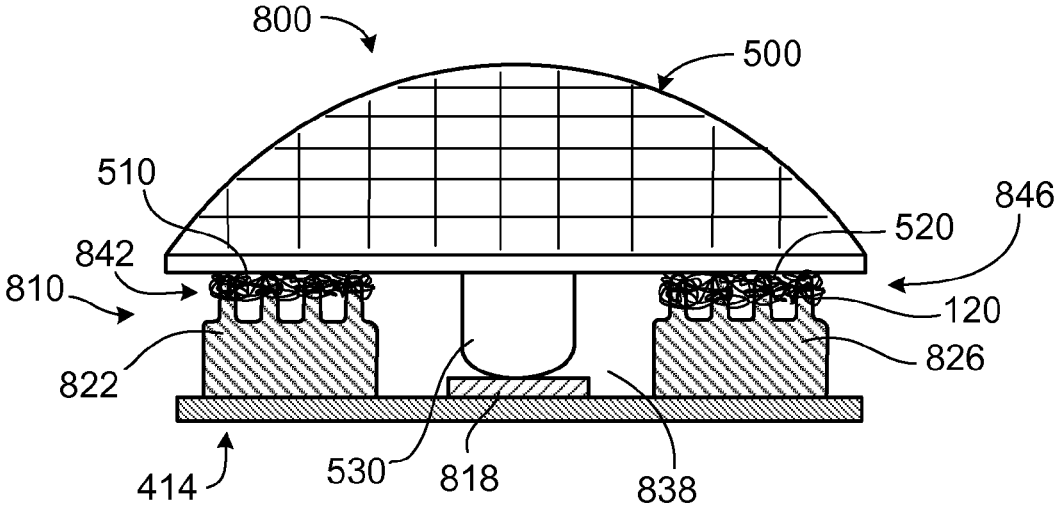
FIG. 15 is a cross-sectional view of an electrical cable and attached lamp.

Referring to FIG. 15, a lighting system 800 includes a lamp 500 releasably attached to an electrical cable 810. The electrical cable 810 includes an electrically insulative strip form base 414 carrying a first and a second electrically conductive fastener strips 842, 846 and a longitudinally continuous electrical conductor 818. Electrical conductor 818 is carried on a front side of strip form base 414 and has an exposed, conductive surface on the front side of the base. First and second conductive strips 842, 846 include fields of fastener elements 120 extending from respective bases 822, 826 and configured to releasably engage with securing portions 510, 520 of the lamp. First and second conductive strips 842, 846 are carried on the front side of the base on respective sides of electrical conductor 818 and spaced from electrical conductor 818. Recessed region 838 and the portion of insulative base 414 extending between electrical conductor 818 and conductive strips 842, 846 can electrically isolate the electrical conductor from the conductive strips. Such electrical isolation does not require the use of separate insulative layer disposed between the conductive strips 842, 846 and the electrical conductor 818.

In use, contact portion 530 of lamp 500 extends into a recessed region 838 at least partially defined by the electrical conductor 818 and the conductive strips 842, 846. In some embodiments, the width of the space between each conductive strip 842, 846 and the electrical conductor 818 is greater than width of the contact portion 530 of lamp 500. Such a width of the spacing between the electrical conductor 818 and each conductive strip 842, 846 can reduce the potential that a user will short-circuit the circuit while locating contact portion 530 on the electrical conductor 818 (e.g., by inadvertently placing the contact portion 530 in electrical communication with both the electrical conductor and at least one conductive strip).

While above-described electrical fastening devices each include a single lamp, additional lamps are also possible. For example, an electrical fastening device can include multiple lamps (e.g., two, three, four, five, six, seven, eight, nine, ten). In some embodiments, each lamp is releasably attachable to one of the above-described electrical cables. In some embodiments, the multiple lamps are mechanically coupled (e.g., part of a single housing) such that the multiple lamps are releasably attachable to one of the above-described electrical cables but the spacing between the multiple lamps remains substantially fixed.

While above-described electrical fastening devices include lamps, other types of electrical devices are possible. In some embodiments, a portable electric device (e.g., cell phones, portable music players, and personal data assistants (PDAs)) can be releasably attached to electrical cable 100 such that powering the electrical cable recharges a battery on the portable electric device. In certain embodiments, a rechargeable battery can be releasably attached to electrical cable 100 to recharge the battery. In certain embodiments, sound speakers can be releasably attached to electrical cable 100 to allow the sound speakers to be arranged in any of various different configurations. For example, a user can releasably position sound speakers along electrical cable 100 to generate a desired acoustic effect.

In some embodiments, an electrically insulative layer can be disposed along a portion of an outer surface of at least some of the fastener elements extending from the above-described electrical cables. Such an electrically insulative layer can permit electricity to pass from the above-described electrical cables to the above-described electrical devices while reducing the risk of passing electricity from the above-described electrical cables to a foreign object (e.g., passing electricity to a person in contact with the electrical cable).

Figure 16:
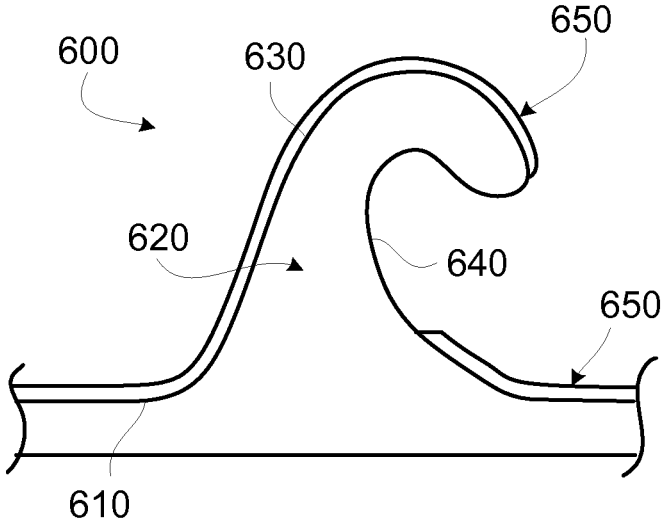
FIG. 16 is a cross-sectional view of a fastener element.

Referring to FIG. 16, for example, a securing strip 600 includes a base with a top surface 610 and a fastener element 620 extending from the top surface. Fastener element 620 includes a line-of-sight surface 630 substantially visible from above the fastener element and a blind surface 640 substantially not visible from above the fastener element. A coating 650 of an electrically insulative material is disposed on securing strip 600 such that the coating substantially covers line-of-sight surface 630 while blind surface 640 remains substantially uncoated. In this configuration, coating 650 electrically insulates portions of securing strip 600 that are more likely to come into contact with a foreign object. Additionally or alternatively, because blind surface 640 remains uncoated, an electrical device can be placed in electrical communication with securing strip 600. For example, fastener element 620 can engage with a conductive loop material such that a conductive loop contacts blind surface 640. Additionally or alternatively, fastener element 620 can engage with a self-engaging fastener such that the mating surfaces of the self-engaging fasteners are substantially uncoated to allow for substantial contact between the mating surfaces of the self-engaging fasteners. While insulative surface coating 650 can improve safety by reducing the likelihood that a user will come into contact with the electrically conductive surfaces, the insulative surface coating can additionally or alternatively increase the aesthetic appeal of an electrical cable including electrically conductive thermoplastic resin. For example, because some electrically conductive thermoplastic resins are made electrically conductive through doping with a highly conductive material, some electrically conductive thermoplastic resins can only be made in the color black. By contrast, the insulative coating 650 can include any of various different colors. With additional color choices, the insulative coating 650 can allow electrical cables to be better concealed when mounted on a wall (e.g., the color can be chosen to substantially match paint on the user's wall.

Insulative surface coating 650 can be applied to securing strip 600, for example, by being sprayed on securing strip 600 from above.

While the above-described electrical cables include hook-shaped fastener elements, other fastener shapes are possible. In some embodiments, fastener elements can include other loop engageable shapes (e.g., flat-head hooks). In some embodiments, fastener elements are self-engaging fastener elements (e.g., fastener elements that are releasably engageable with other similarly shaped fastener elements).

Figure 17:
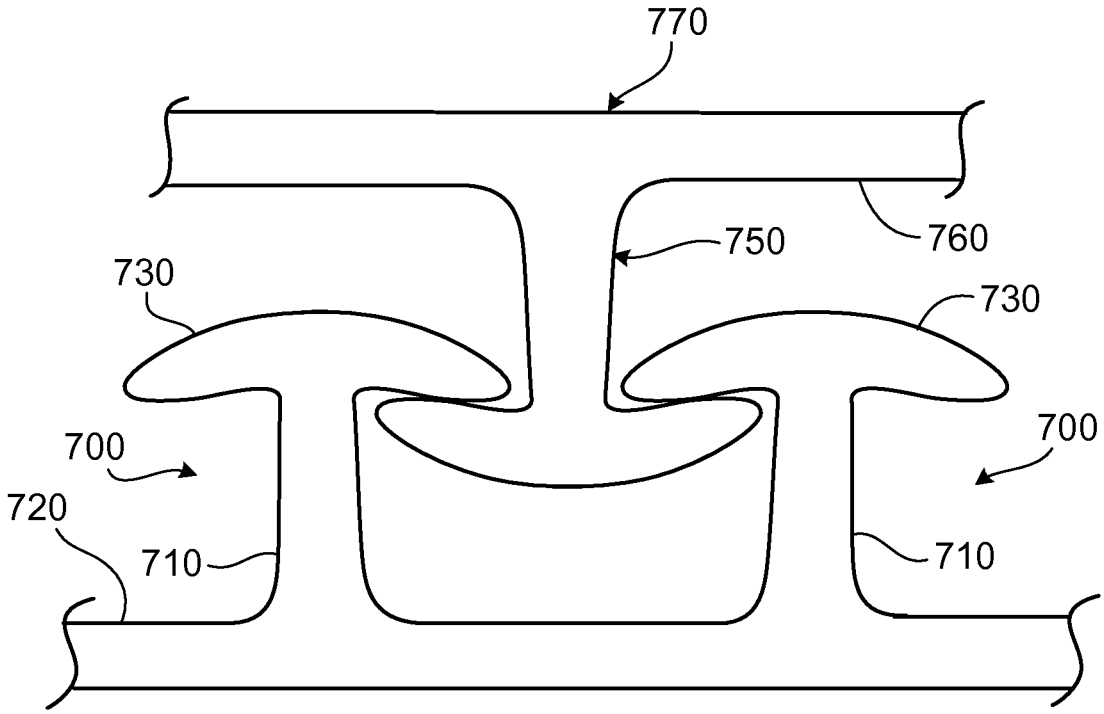
FIG. 17 is a side view of self-engaging fastener elements.

Referring to FIG. 17, for example, a fastener element 700 includes a stem portion 710 extending from (e.g., integrally formed with) base 720. Head portion 730 extends from (e.g., is integrally formed with) stem portion 710. Head portion 730 is shaped to allow fastener element 730 to engage realeasably with a similarly-shaped head of another fastener element 750 extending from a surface 760 of electrical device 770. Head portion 730 can be any of various different shapes including substantially mushroom-shaped and substantially palm-tree shaped. Other self-engaging hooks can be used, such as those found in from U.S. provisional patent application 60/947,919, filed on Jul. 3, 2007, and entitled "ARRAYS OF FASTENER ELEMENTS," the entire contents of which are herein incorporated by reference. Self-engaging fasteners can also provide a reduced likelihood of short-circuiting relative to conductive loop material which can fray under some circumstances.

While the above-described electrical cables have been described as including some type of registration (e.g., alignment) between a highly conductive portion of the cable and a less conductive portion of the cable, electrical-cables can be self-registering.

Figure 18:
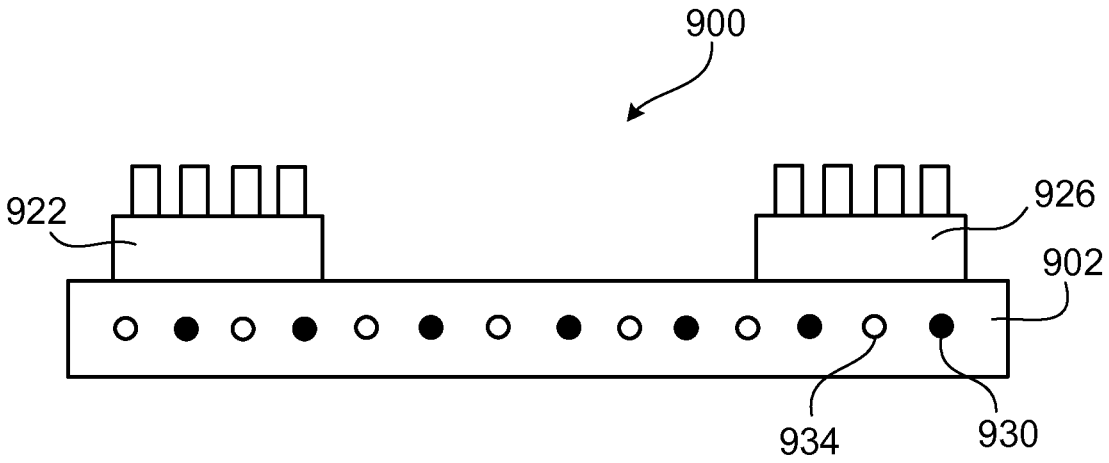
FIG. 18 is a cross-sectional view of an electrical cable.

Referring to FIG. 18, an electrical cable 900 includes a first and a second electrically conductive fastener strip 922, 926 carried on a surface of an insulative base 902. The insulative base 902 includes a plurality of fibers arranged in a substantially regular pattern (e.g., a weave, a knit). The fibers of the insulative base 902 can include a plurality of conductive fibers 930 interwoven with a plurality of nonconductive fibers 934. In the resulting weave, the conductive fibers 930 are substantially uniformly dispersed along the insulative base 902. The conductive fibers 930 contact the conductive fastener strips at substantially regular intervals, according to the pattern of the weave. In some implementations, a plurality of conductive fibers 930 contact the conductive fastener strips at substantially regular intervals to establish electrical communication between the conductive fibers and the conductive fastener strips 922, 926. Because the plurality of conductive fibers 930 arranged at substantially uniform intervals along the base 902, the conductive fastener strips 922, 926 can be placed at any point along the base to achieve electrical communication with the plurality of conductive fibers 930. Thus, for example, by reducing the need to register fastener strips 922, 926 relative to the insulative base, electrical cable 900 can be produced using cost-effective manufacturing process with a reduced need for the equipment, tooling, and labor associated with registration of components of an electrical cable.

What is claimed is:

1. An electrical cable comprising:

a first conductive strip and a second conductive strip, each conductive strip including:

a longitudinally continuous electrical conductor;

an electrically conductive thermoplastic resin in contact with the electrical conductor and having a lower electrical conductivity than the electrical conductor, the electrically conductive thermoplastic resin forming both an exposed surface of the cable and a field of fastener element stems extending from the exposed surface; and an electrically insulative base extending between and joining the first conductive strip and the second conductive strip and electrically isolating the first conductive strip from the second conductive strip.

2. The cable of claim 1 wherein each longitudinally extending electrical conductor is at least partially embedded within the electrically conducting thermoplastic resin.

3. The cable of claim 1 wherein each longitudinally extending electrical conductor is at least partially embedded within the electrically insulative base.

4. The cable of claim 1 wherein the electrically insulative base includes a lane of an electrically insulative resin disposed directly between the first conductive strip and the second conductive strip.

5. The cable of claim 1 further comprising an electrically insulative layer disposed along a portion of an outer surface of at least some of the fastener elements of each field.

6. The cable of claim 5, wherein each fastener comprises user exposed surfaces and substantially unexposed surfaces, the electrically insulative layer disposed along the exposed surfaces of the fastener, and substantially unexposed surfaces of the fasteners substantially uncoated to permit electrical communication through one or more of the substantially unexposed surfaces.

7. The cable of claim 1 wherein at least one of the longitudinally continuous electrical conductors comprises conductive yarn extending along the cable.

8. The cable of claim 7 further comprising a wire at least partially embedded in the conductive yarn.

9. The electrical cable of claim 1, wherein the first conductive strip is electrically isolated from the second conductive strip.

* * * * *

UNITED STATES PATENT AND TRADEMARK OFFICE

CERTIFICATE OF CORRECTION

PATENT NO. : 8,440,912 B1
APPLICATION NO. : 13/251506
DATED : May 14, 2013
INVENTOR(S) : David P. Kraus, Jr. et al.

It is certified that error appears in the above-identified patent and that said Letters Patent is hereby corrected as shown below:

Other Publications under item (56),

Title Page 2, Col. 2, line 11, delete “Bakaert” and insert -- Bekaert --;

Title Page 2, Col. 2, line 12, delete “Bakaert” and insert -- Bekaert --;

Title Page 2, Col. 2, line 12, delete “Technolgies,” and insert -- Technologies, --.

Signed and Sealed this
Seventeenth Day of September, 2013

Teresa Stanek Rea
*Deputy Director of the United States Patent and Trademark Office*